US007168339B2

(12) United States Patent
Nau

(10) Patent No.: US 7,168,339 B2
(45) Date of Patent: Jan. 30, 2007

(54) DUAL HEADED HAMMER

(76) Inventor: Tevita T. Nau, P.O. Box 199, Sparks, NV (US) 89432-0199

( * ) Notice: Subject to any disclaimer, the term of this patent is extended or adjusted under 35 U.S.C. 154(b) by 99 days.

(21) Appl. No.: 10/992,883

(22) Filed: Nov. 19, 2004

(65) Prior Publication Data

US 2005/0115365 A1 Jun. 2, 2005

Related U.S. Application Data

(63) Continuation-in-part of application No. 10/285,181, filed on Oct. 31, 2002, now abandoned.

(51) Int. Cl.
*B25D 1/00* (2006.01)

(52) U.S. Cl. ..... 81/23; 81/26; 7/143; 7/164

(58) Field of Classification Search ..... 7/143, 7/146, 147, 164; 81/20, 23, 24, 26
See application file for complete search history.

(56) References Cited

U.S. PATENT DOCUMENTS

| | | | | | |
|---|---|---|---|---|---|
| 29,760 | A * | 8/1860 | Boeklen | 81/24 |
| 569,161 | A * | 10/1896 | Balsley | 81/23 |
| 755,355 | A * | 3/1904 | Carlsen | 81/20 |
| 2,821,222 | A * | 1/1958 | Mount | 81/24 |
| 3,640,324 | A * | 2/1972 | Porter | 81/20 |
| 4,291,998 | A * | 9/1981 | Santos | 403/263 |
| 4,336,832 | A * | 6/1982 | Poulos | 81/20 |
| 4,433,709 | A * | 2/1984 | Porter | 81/26 |
| 4,732,058 | A * | 3/1988 | Chung | 81/20 |
| 4,813,089 | A * | 3/1989 | Anderson | 7/143 |
| 5,216,939 | A * | 6/1993 | Swenson | 81/25 |
| 5,255,575 | A * | 10/1993 | Williams | 81/25 |
| 5,345,636 | A * | 9/1994 | Lamons | 7/139 |
| 5,526,719 | A * | 6/1996 | Chen | 81/25 |
| 5,884,900 | A * | 3/1999 | Gobeil et al. | 254/21 |
| 5,933,894 | A * | 8/1999 | Bates | 7/164 |
| 6,299,136 | B1 * | 10/2001 | Nakayama | 254/26 R |
| 6,332,376 | B1 * | 12/2001 | Hurley | 81/23 |
| 6,435,059 | B1 * | 8/2002 | Martinez | 81/20 |
| 6,571,666 | B1 * | 6/2003 | Te | 81/24 |

* cited by examiner

*Primary Examiner*—D. S. Meislin
(74) *Attorney, Agent, or Firm*—John D. Gugliotta

(57) ABSTRACT

A dual headed hammer is a hammer with special features for framing and finishing applications. A first head of the hammer has a smaller head and face for finish carpentry applications, and may have a gridded-face to prevent nail slippage. A nail-extractor is located midway between the head and the handle. The opposite end of the hammer has a larger second head for framing applications. Additionally, the larger second head has a plurality of nail holders, complete with magnets, on the top and lateral sides of the second head. The handle is sized such that the total length of the invention is exactly 17.5 inches to aid in construction of walls that use 2×4 studs, 16 inches on center.

19 Claims, 6 Drawing Sheets

DUAL HEADED HAMMER

RELATED APPLICATIONS

This application is a continuation-in-part of U.S. patent application Ser. No. 10/285,181 filed on Oct. 31, 2002, now abandoned.

BACKGROUND OF THE INVENTION

1. Field of the Invention

The present invention relates generally to hammer, and more specifically to a dual headed hammer.

2. Description of the Related Art

Construction and wood working projects require a variety of tools and accessories in order to ensure proper measurements for sizing pieces prior to performing cuts and/or assembly. As a result, there are a variety of core or base tools that are required when performing virtually any physical task. Some of the most common tools used in such tasks are the framing hammer, the finish hammer, and the measuring aid such as a tape measure. The framing hammer, with its large head is commonly used for driving large nails such as would be encountered during wall and roof construction. The finish hammer is used to drive smaller headed nails such as would be encountered in molding installation or cabinetry work. Finally, the tape measure is commonly used to measure repeated dimensions such as wall stud spacing when using 2×4's. Many construction procedures require the worker to juggle all of these tools while holding the object to be nailed in place. Such actions not only waste time, but accuracy also suffers if the object should move slightly while the other tool is being reached for. Accordingly, there is a need for a means by which the functions of a framing hammer, a finish hammer and a measuring device can be combined into one tool in a manner, which is easy and effective.

A search of the prior art did not disclose any patents that read directly on the claims of the instant invention; however, the following references were considered related:

U.S. Pat. No. 6,347,562, issued in the name of Gerber, Jr., discloses a multi-purpose hand tool with multiple interchangeable utility heads and safety lock;

U.S. Pat. No. 5,216,939, issued in the name of Swenson, discloses a hammer head with removable tip;

U.S. Pat. No. 5,211,085, issued in the name of Liou, discloses a hammer with bifurcated handle portion;

U.S. Pat. No. 5,012,702, issued in the name of Taylor, discloses a split head hammer;

U.S. Pat. No. Des. 350,470, issued in the name of Majors et al., discloses the ornamental design for a combined handle and head for a hammer;

U.S. Pat. No. 5,657,674, issued in the name of Burnett, discloses a composite hammer with enhanced vibration dampening characteristics;

U.S. Pat. No. 5,408,902, issued in the name of Burnett, discloses a composite hammer with enhanced vibration dampening characteristics; and U.S. Pat. No. 2,761,478, issued in the name of Guida, discloses a hammer head with removable tip.

Consequently, there exists a need for new product ideas and enhancements for existing products in the hammer industry.

SUMMARY OF THE INVENTION

It is therefore an object of the present invention to provide a dual headed hammer.

It is a feature of the present invention to provide a dual headed hammer having a first head adapted for use on finish carpentry, and a second head adapted for use on framing carpentry.

It is still a further feature of the present invention to provide a dual head hammer having a diamond-shaped nail extractor.

It is still a further feature of the present invention to provide a dual headed hammer having a plurality of nail holders with magnets, each nail holder adapted to accommodate a variety of nail sizes.

Briefly described according to one embodiment of the present invention, a dual headed hammer is a hammer with special features for framing and finishing applications. A first head of the hammer has a smaller head and face for finish carpentry applications, and may have a gridded-face to prevent nail slippage. A nail-extractor is located midway between the head and the handle. The opposite end of the hammer has a larger second head for framing applications. Additionally, the larger second head has a plurality of nail holders, complete with magnets, on the top and lateral sides of the second head. The handle is sized such that the total length of the invention is exactly 17.5 inches to aid in construction of walls that use 2×4 studs, 16 inches on center. The use of the dual headed hammer not only reduces the number of tools that a worker must carry, but also reduces the number of steps that must be taken in common construction procedures while increasing accuracy and improving workmanship.

The use of the present invention provides users with all of the materials and tools necessary to ensure that a user may easily use and maintain a dual headed hammer.

An advantage of the present invention is that it is specifically adapted for personal use because of the light weight components and the use of inexpensive materials.

A further advantage of the present invention is that it is specifically adapted to have dimensions and etchings to accurately measure and mark a series of wall studs.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
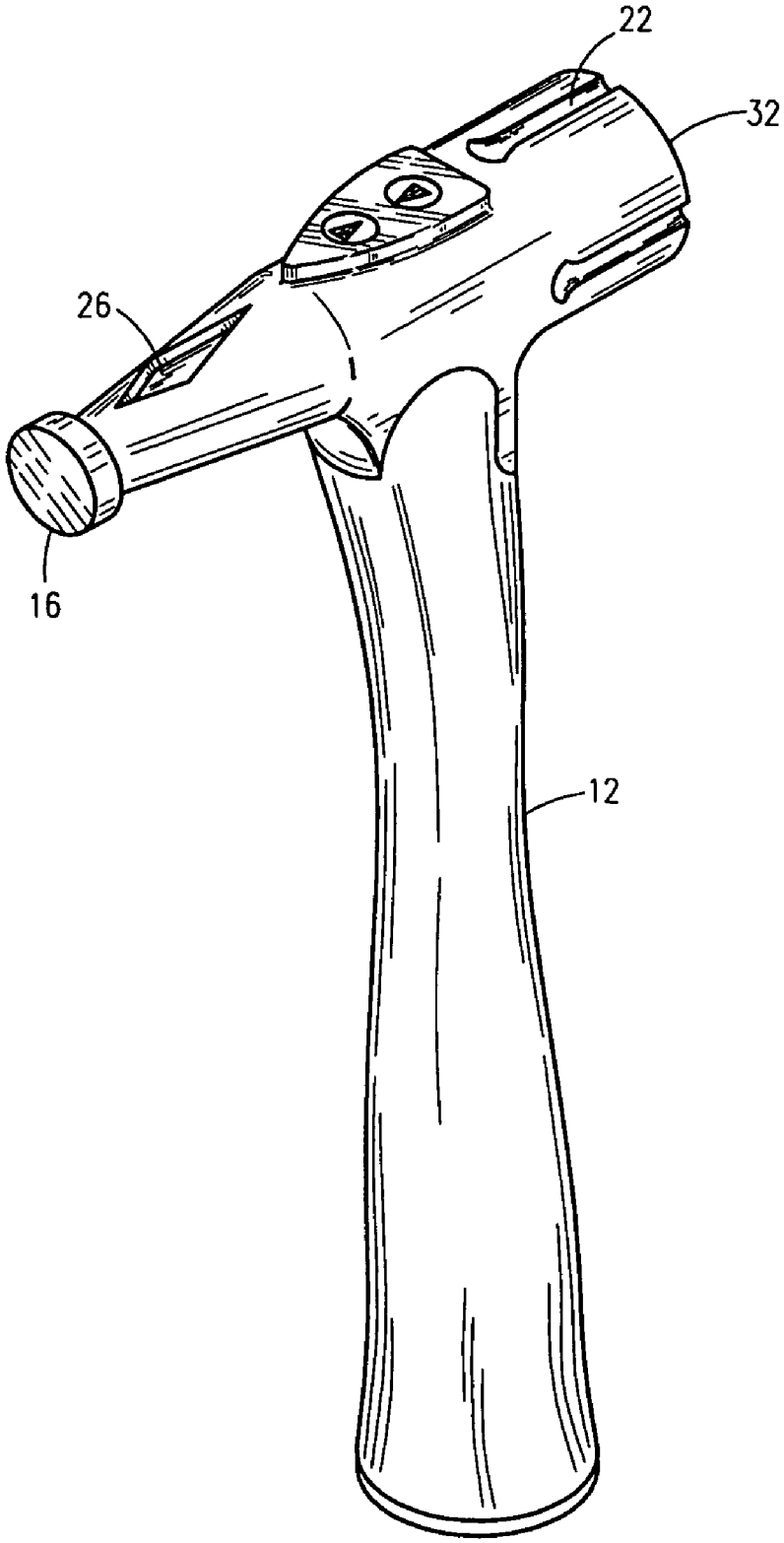
FIG. 1 is a perspective view of a dual head hammer.

The best mode for carrying out the invention is presented in terms of its preferred embodiment, herein depicted within the Figures.

1. Detailed Description of the Figures

Referring now to FIG. 1 through FIG. 4, a dual headed hammer 10, in accordance with the preferred embodiment of the present invention, is shown. The dual headed hammer 10 comprises a handle 12 affixed to a triangulated dual head 14. The dual head 14 comprises a first head 16 and a second head 18 opposite to the first head 16, a plurality of nail holders 20, 22 and 24, a diamond-shaped nail extractor 26 and a receiving orifice 28 for receiving and securely housing an end of the handle 12.

Figure 6:
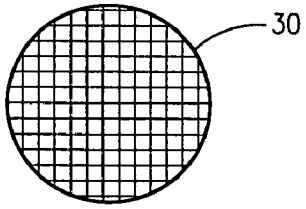
FIG. 6 is a front view of a second head and second face, illustrating the grid surface and a top nail holder and a first and second lateral nail holder.
Figure 7:
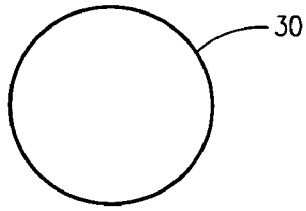
FIG. 7 is a front view of the component shown in FIG. 6, but instead illustrating a smooth surface.

Referring to FIG. 2 through FIG. 4, and FIG. 6 through FIG. 9, the first head 16 is approximately three-eighths of an inch (0.375 inches) to one (1) inch in diameter, although the preferable range is one-half inch (0.5 inches) to three-fourths of an inch (0.75 inches). The first head 16 is sized specifically for nailing applications involving "finish carpentry," which includes nailing of moldings, baseboards, laminates, paneling, cabinets and cabinet-components and other similar items. Typically, finish carpentry involves nailing of nails or tacks that are significantly smaller than a nail used for attaching lumber, thus the smaller head allows greater control and helps to prevent dings and dints on finished items. In one embodiment of the first head 16 (as shown in FIG. 6), a first face 30 has a heat-treated grid surface, which provides a frictionally enhanced surface resistant to slipping when the first face 30 impacts a nail head. In an alternative embodiment of the first head 16 (as shown in FIG. 7), a first face 30 has a smooth surface, which provides the advantage of not imparting a gridded imprint on a surface when the first face 30 impacts a surface.

Figure 8:
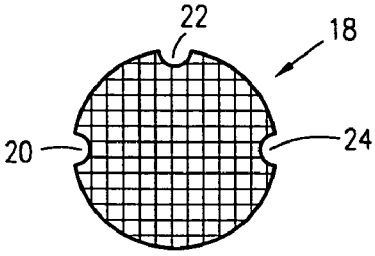
FIG. 8 is a front view of a first head and first face, illustrating the grid surface.
Figure 9:
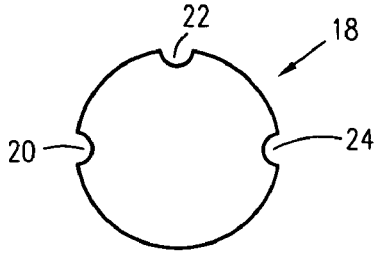
FIG. 9 is a front of the component shown in FIG. 8, but instead illustrating a smooth surface.

The second head 18 is approximately three-fourths of an inch (0.75 inches) to two (2) inches in diameter, although the preferable range is one (1) inch to one and three-fourths (1.75) inches. The second head 18 is sized specifically for nailing applications involving "framing," which includes nailing of pressure-treated lumber, plywood, fiberboard, sheet-rock, shingles or a variety of other applications. Typically, framing carpentry involves nailing of nails that are larger than the finishing nails or tacks described above, thus the larger head allows for more power and impact, thereby driving the nails through thick or knotted sections of lumber. In one embodiment of the second head 18 (as shown in FIG. 8), a second face 32 has a heat-treated grid surface, which provides a frictionally enhanced surface resistant to slipping when the second face 32 impacts a nail head. In an alternative embodiment of the second head 18 (as shown in FIG. 9), a second face 32 has a smooth surface, which provides the advantage of not imparting a gridded imprint on a surface when the second face 32 impacts a surface.

Referring now to FIG. 2, FIG. 3, FIG. 4, FIG. 8 and FIG. 9, the plurality of nail holders 20, 22 and 24 are positioned along the perimeter of and channeled perpendicularly to the second face 32 of the second head 18. The nail holders 20, 22 and 24 include a top nail holder 22 and a first lateral nail holder 20 and a second lateral nail holder 24 opposite to first lateral nail holder 20. The top nail holder 22 is an arcuate channel formed in the top surface of the second head 18, wherein the top nail holder 22 is sized to accept the largest sized nails typically used, which generally range from ninepenny up to seventypenny nails. The top nail holder 22 further includes a magnet 34 housed within the arcuate channel thereby providing a means for securely holding a nail in place so that it may be started into a wall without the need of a user positioning the nail with a hand. The first lateral nail holder 20 is an arcuate channel formed in a lateral surface of the second head 18, wherein the first lateral nail holder 20 is sized to accept the smallest sized nails typically used, which generally range from twopenny up to sevenpenny nails. The first lateral nail holder 20 further includes a magnet 34 housed within the arcuate channel thereby providing a means for securely holding a nail in place so that it may be started into a wall without the need of a user positioning the nail with a hand. The second lateral nail holder 24 is an arcuate channel formed in a lateral surface of the second head 18, wherein the second lateral nail holder 24 is sized to accept an intermediate size of nails typically used, which generally range from eightpenny up to twelvepenny nails. The second lateral nail holder 24 further includes a magnet 34 housed within the arcuate channel thereby providing a means for securely holding a nail in place so that it may be started into a wall without the need of a user positioning the nail with a hand.

The nail size ranges discussed above are listed in the chart below as a reference guide and conversion to lengths more commonly known:

| Nail Size | Inches | Centimeters |
|---|---|---|
| 2d (twopenny) | 1.00 | 2.540 |
| 3d (threepenny) | 1.25 | 3.175 |
| 4d (fourpenny) | 1.50 | 3.810 |
| 5d (fivepenny) | 1.75 | 4.445 |
| 6d (sixpenny) | 2.00 | 5.080 |
| 7d (sevenpenny) | 2.25 | 5.715 |
| 8d (eightpenny) | 2.50 | 6.350 |
| 9d (ninepenny) | 2.75 | 6.985 |
| 10d (tenpenny) | 3.00 | 7.620 |
| 12d (twelvepenny) | 3.25 | 8.255 |
| 16d (sixteenpenny) | 3.50 | 8.890 |
| 20d (twentypenny) | 4.00 | 10.160 |
| 30d (thirtypenny) | 4.50 | 11.430 |
| 40d (fortypenny) | 5.00 | 12.700 |
| 50d (fiftypenny) | 5.50 | 13.970 |
| 60d (sixtypenny) | 6.00 | 15.240 |
| 70d (seventypenny) | 7.00 | 17.780 |

Figure 2:
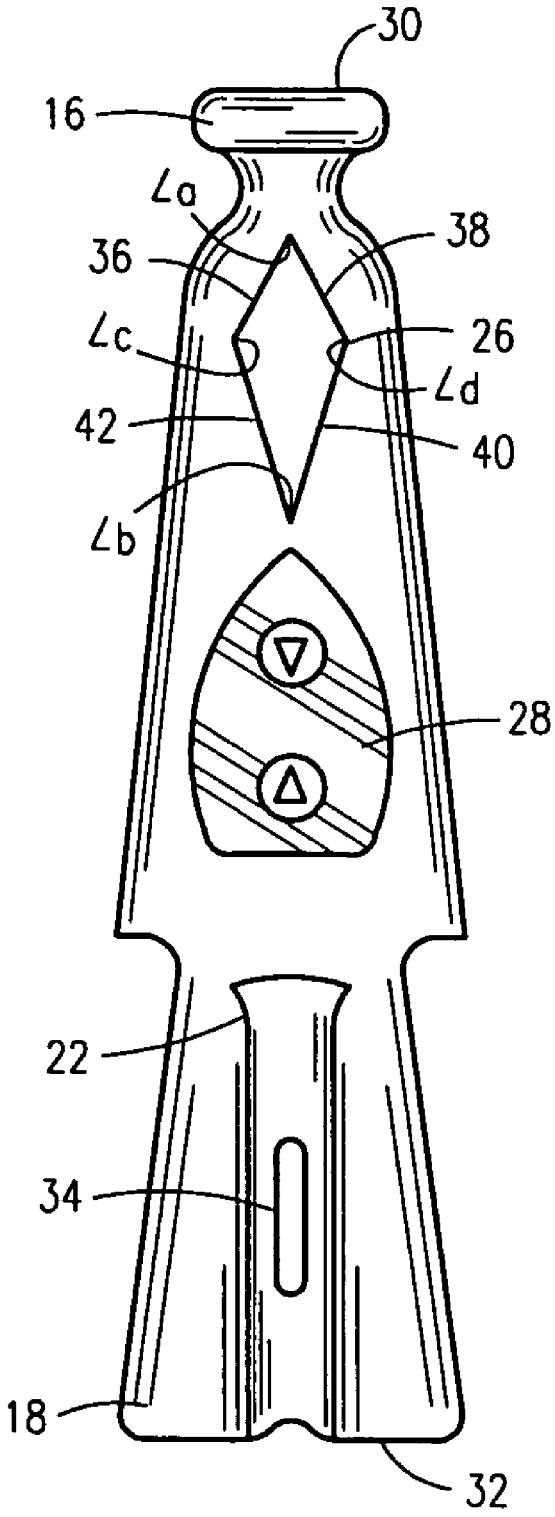
FIG. 2 is a top view of a dual head of the apparatus of FIG. 1.
Figure 3:
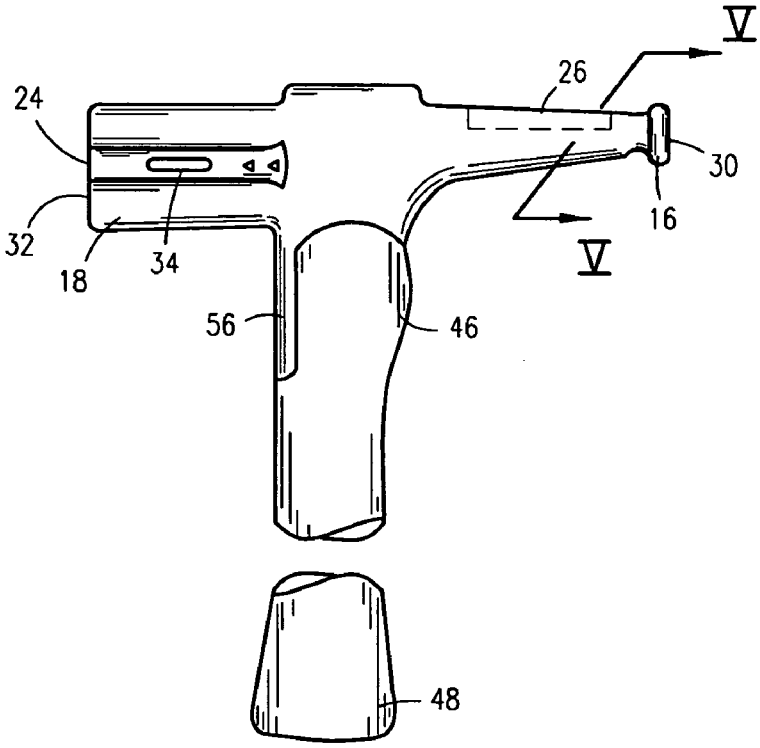
FIG. 3 is a side view of the apparatus of FIG. 1.
Figure 4:
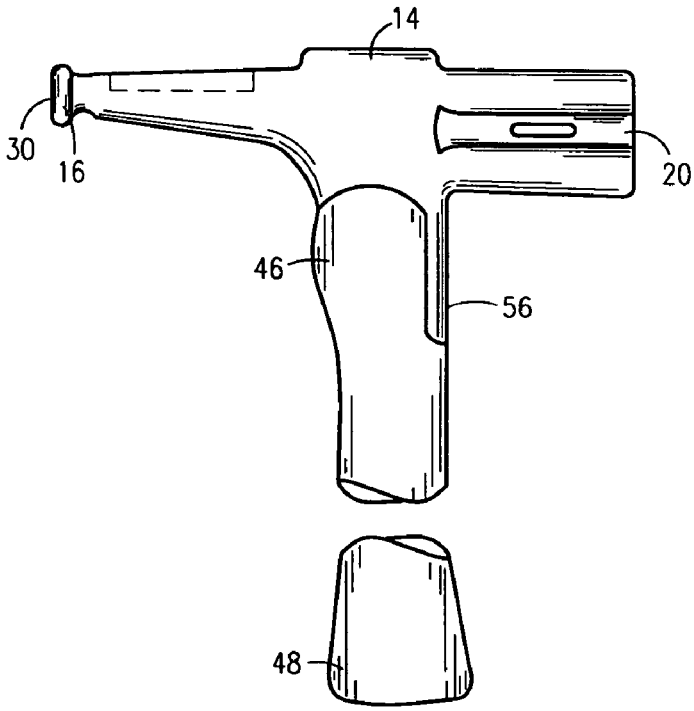
FIG. 4 is a side view of the apparatus of FIG. 1 and is an opposite side view of that given in FIG. 3.
Figure 5A:
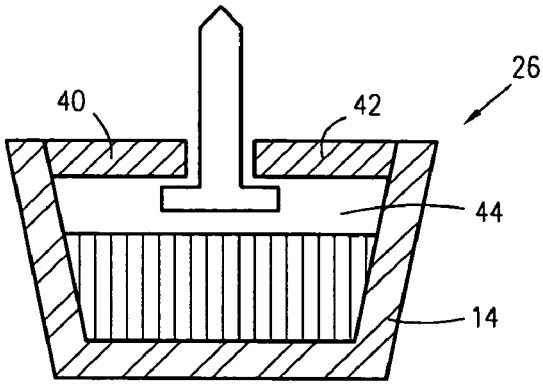
FIG. 5A is a cross-sectional view of the diamond-shaped nail retractor, taken through the line V—V of FIG. 3, and illustrating the rectangular shape of the sections comprising the nail retractor.
Figure 5B:
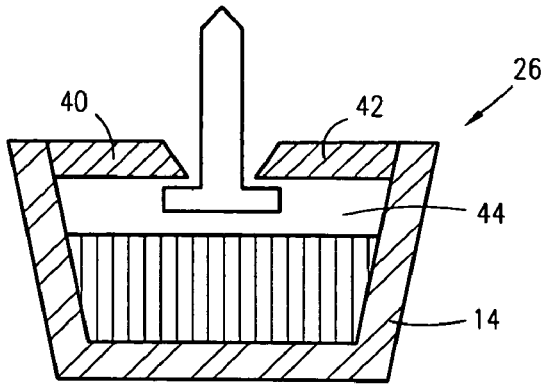
FIG. 5B is a cross-sectional view of the diamond-shaped nail retractor, taken through the line V—V of FIG. 3, and illustrating the angled shape of the sections comprising the nail retractor.
Figure 10:
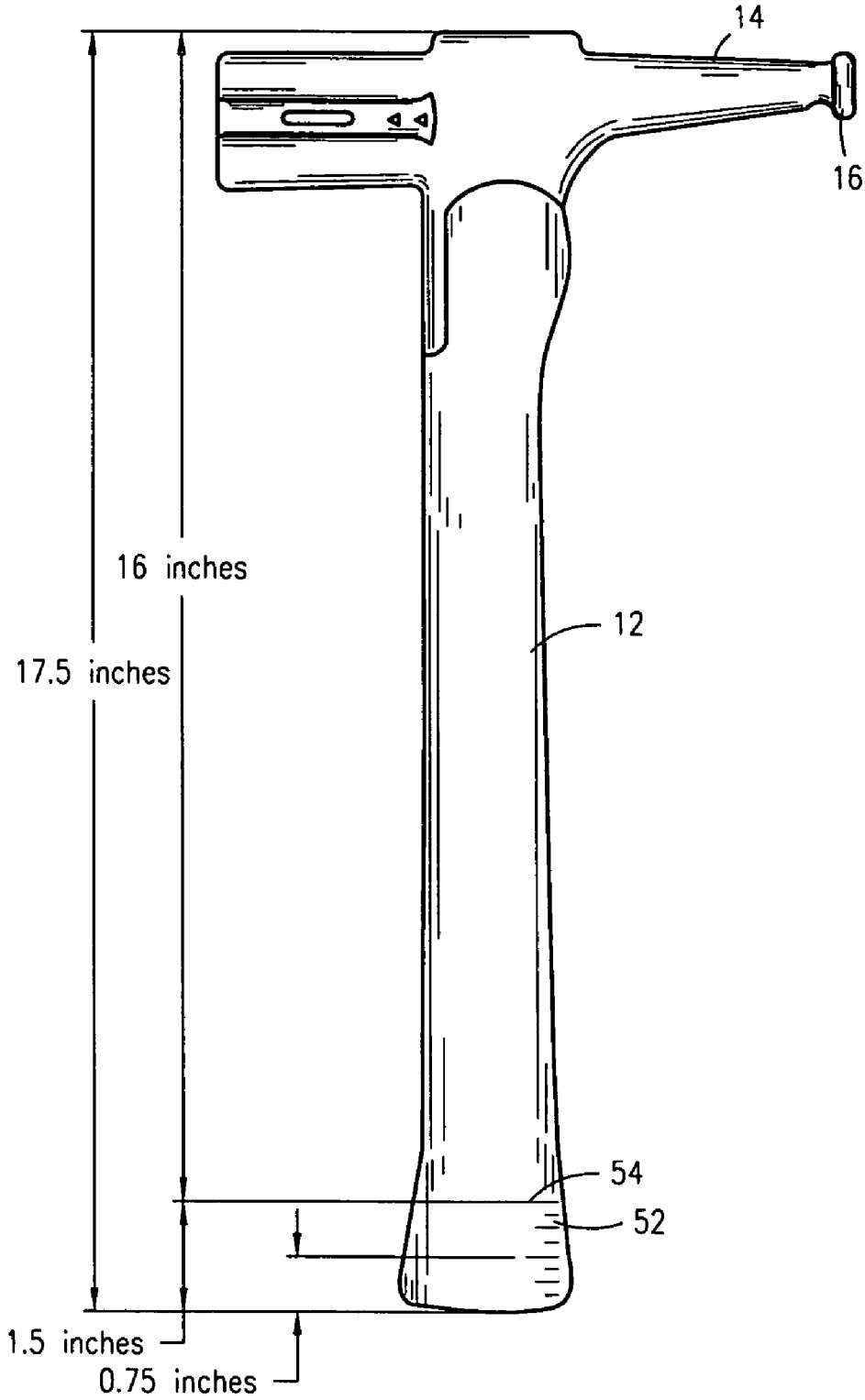
FIG. 10 is a side view of the apparatus of FIG. 1 illustrating the proportional dimensions of the handle and dual head as used for accurately measuring a length between wall studs.
Figure 11:
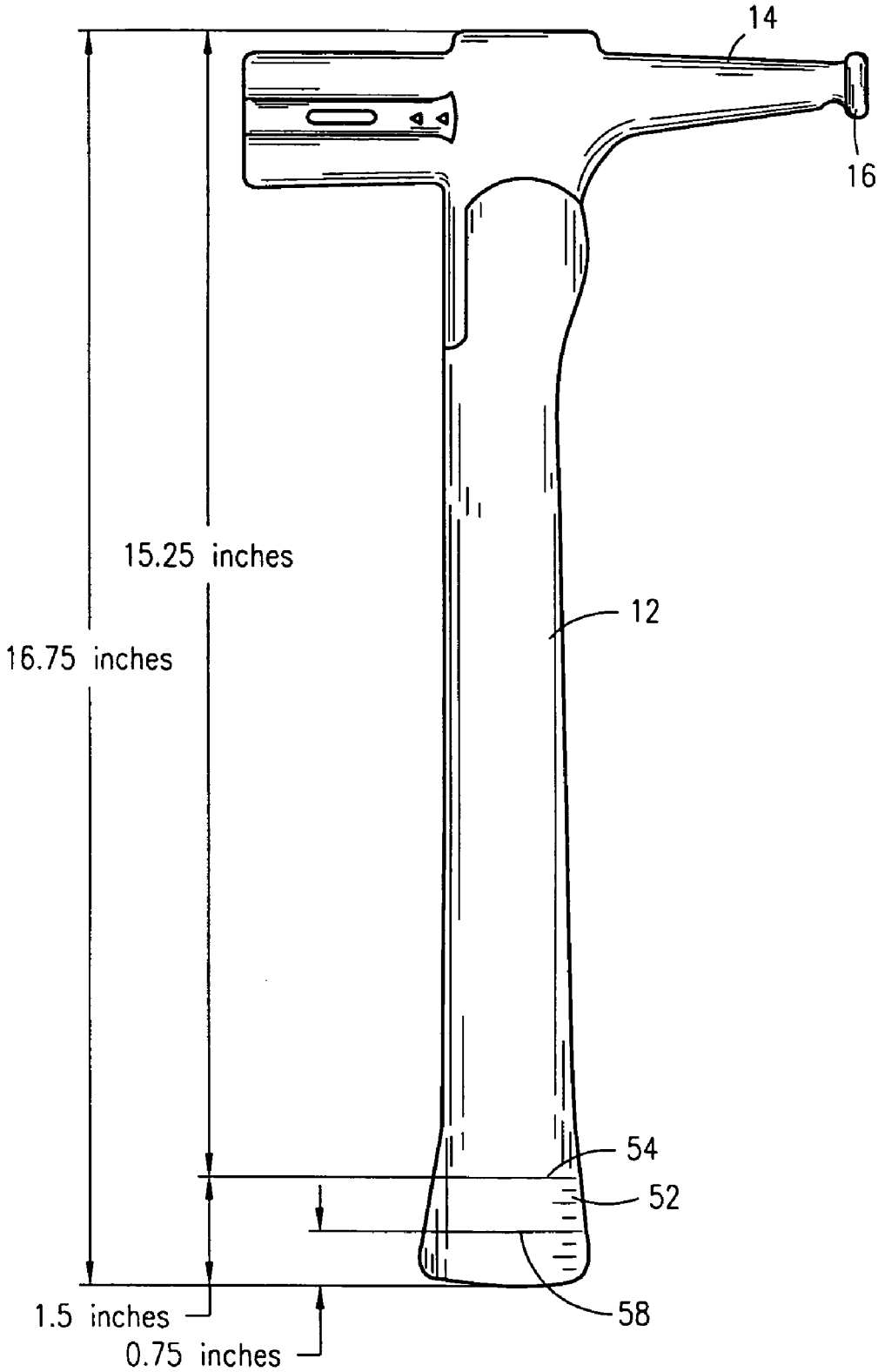
FIG. 11 is a side view of the apparatus of FIG. 1 illustrating alternate proportional dimensions of the handle and dual head.

Referring now to FIG. 2, FIG. 5A and FIG. 5B, the diamond-shaped nail extractor 26 is positioned on the top surface of the dual head 14, and adjacent to the first head 16. The nail extractor 26 comprises a diamond-shaped opening formed by a first, second, third and fourth section 36, 38, 40 and 42, wherein the first and second sections 36 and 38 converge at an acute angle "∠a" and the third and fourth sections 40 and 42 converge at an acute angle "∠b" opposite to angle "∠a". The first and fourth sections 36 and 42 converge at an obtuse angle "∠c" and the second and third sections 38 and 40 converge at an obtuse angle "∠d" opposite to angle "∠c". As best seen in the cross-sectional view of FIG. 5A, the first, second, third and fourth section 36, 38, 40 and 42 may have a rectangular form, or alternatively, a angled form (see FIG. 5B). A space 44 is formed below the first, second, third and fourth section 36, 38, 40 and 42, which receives a nail head for preparation in extracting a nail from a wall, a board or other similar objects. The diamond-shaped arrangement of the nail extractor 26 is provided to accommodate a variety of nail sizes, from the smallest tacks to the largest of carpentry nails. Referring now to FIG. 3, FIG. 4 and FIG. 10, the handle 12 is a linearly elongated member having an upper portion 46 and a lower portion 48 opposite to the upper portion 46. The handle 12 may be manufactured from wood, metal, plastic or a variety of other resilient and durable materials. The handle 12 is sized so that when the handle 12 is affixed to the dual head 14, the length from the top surface of the dual head 14 to the base of the handle 12 is in a range between sixteen (16) inches and eighteen (18) inches. In one embodiment, depicted in FIG. 10, the length from the top surface of the dual head 14 to the base of the handle 12 is seventeen and one-half (17.5) inches. In another embodiment, depicted in FIG. 11, the length from the top surface of the dual head 14 to the base of the handle 12 is sixteen and three-fourths (16.75) inches. If the handle 12 is manufactured from wood, the handle 12 will be affixed through a receiving orifice 28 (discussed below) and supported by a boss 56. The handle 12 can have a variety of design shapes, including soft curves or ergometrically directed shapes. For example, and as illustrated by FIG. 10, the handle may have a gradual curve toward the posterior of the apparatus. At the lower portion 48 a vertical front edge is included having etchings 52 to designate one and one-half (1.5) inches. The etchings 52 have at least two functions. In framing a wall, wall studs are place sixteen (16) inches on center, with the width of the stud generally being one and one-half (1.5) inches. Generally, a carpenter would use a tape measure to measure the length accurately. Because the hammer 10 is provided with a seventeen and one-half (17.5) inches length, and because the etchings 52 measure one and one-half (1.5) inches, a user can place the top surface of the hammer 10 at one wall edge or stud and measure up to the uppermost ringed etching 54, which indicates sixteen (16) inches, thereby providing an accurate on-center or off-center measuring of one stud in relation to the next stud. As a second example, and using the embodiment depicted in FIG. 11, wherein the length of the hammer 10 measures sixteen and three-fourths (16.75) inches, the etchings 52 measure one and one-half (1.5) inches as in the previous example. However, the length between the top surface of the hammer 10 and the uppermost ringed etching 54 measures fifteen and one-fourth (15.25) inches. A second ringed etching 58 is provided at a distance three-fourths (0.75) inches from the base of the handle 12. In this embodiment, the length from the top surface of the hammer 10 and the second ringed etching 58 measures sixteen (16) inches, thereby providing an accurate on-center or off-center measuring of one stud in relation to the next stud.

Referring back to FIG. 2, the receiving orifice 28 is an elliptically shaped orifice which receives and houses the upper portion 46 of a wood or plastic based handle 12. The upper portion 46 is physically impinged within the receiving orifice 28 and is further held in place by a pair of metal eye supports.

It is envisioned that other styles and configurations of the present invention can be easily incorporated into the teachings of the present invention, and only one particular configuration shall be shown and described for purposes of clarity and disclosure and not by way of limitation of the scope.

2. Operation of the Preferred Embodiment

The dual headed hammer 10 may be used as a hammer is used, which is to drive or extract nails from various materials. The dual head 14 is included to provide flexibility of use, depending upon the size of the nail used and/or the surface through which the nail will be driven. If a user wishes to use the second head 18 to drive a framing nail, the user may choose to employ the nail holders 20, 22 and 24 to help start the nail into the material. The nail is placed within the nail holder 20, 22 or 24 and the user provides an initial tap to start the nail into the material. The nail will slide away from the magnet 34. The user may then proceed in driving the nail with the dual headed hammer 10.

To measure for placement of a stud during the framing process, a user may place the top surface of the dual head 14 so that it aligns with an edge or a previous stud. The user may then use the length of the handle 12 to measure to the etching ring 54, which is sixteen (16) inches and corresponds to the standard length between wall studs.

To extract a nail using the nail extractor 26, place the widest portion of the opening over the nail head that will be extracted. Then, slide the hammer 10 until the nail head is impinged within the sections 36, 38, 40 and 42 and then pull to extract the nail.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. A dual headed hammer comprising:

a linearly elongated handle having an upper portion opposite to a lower portion, said handle having measurement etchings measuring 1.5 inches in length from a base of said handle and extending to an uppermost ringed etching, said handle measuring 16.75 inches in length from a top surface of said hammer to a lower surface for quickly and accurately determining placement or location of a wall stud; and a dual head receiving and physically impinging said upper portion of said handle in a receiving orifice, each one of said heads for driving a nail.

2. The dual headed hammer of claim 1, wherein said handle includes a curvilinear form at said base of said handle, said curvilinear form curved toward a posterior of said hammer, said curvilinear form ergonomically shaped to reduce stress and injury to a user's hands, wrists and arms.

3. The dual headed hammer of claim 1, wherein said dual head comprises:

a first head formed at an end of said dual head having a first face for striking a head of a nail;

a second head formed at an end opposite to said first head and having a second face for striking a head of a nail;

a plurality of nail holders formed in said second head.

4. The dual headed hammer of claim 3, wherein said first head has a diameter measuring between 0.375 inches and 1 inch, said first head sized to perform finish carpentry applications, thereby preventing denting and dinging of the finish material.

5. The dual headed hammer of claim 3, wherein said first face comprises a heat-treated grid surface, said grid surface providing a frictionally enhanced surface resistant to slipping when said first face strikes said head of said nail.

6. The dual headed hammer of claim 3, wherein said first face comprises a smooth surface not imparting a gridded imprint when said first face strikes a surface.

7. The dual headed hammer of claim 3, wherein said second head has a diameter measuring between 0.75 inches and 2 inches, said second head sized to perform framing applications, thereby providing the weight and force necessary to drive large framing nails.

8. The dual headed hammer of claim 3, wherein said second face comprises a heat-treated grid surface, said grid surface providing a frictionally enhanced surface resistant to slipping when said second face strikes said head of said nail.

9. The dual headed hammer of claim 3, wherein said second face comprises a smooth surface, said smooth surface not imparting a gridded imprint when said second face strikes a surface.

10. The dual headed hammer of claim 3, wherein said plurality of nail holders comprises:

a top nail holder having an arcuate channel formed in a top surface of said second head, said top nail holder sized to accommodate large nails;

a first lateral nail holder having an arcuate channel formed in a lateral surface of a second head, said first lateral nail holder sized to accommodate small nails; and a second lateral nail holder having an arcuate channel formed in a lateral surface of said second head, opposite to said first lateral nail holder, said second lateral nail holder sized to accommodate intermediate nails.

11. The dual headed hammer of claim 10, wherein said top nail holder, said first lateral nail holder and said second lateral nail holder each further comprise a magnet housed within said arcuate channel, said magnet providing means for securely holding a nail in place while a user strikes a nail.

12. The dual headed hammer of claim 1, wherein said dual head further comprises a nail extractor, said nail extractor formed in a top surface of said dual head and adjacent to said first head, said nail extractor for extracting impaled nails.

13. The dual headed hammer of claim 12, wherein said nail extractor comprises:

a first section;

a second section, said second section and said first section converging at an acute angle;

a third section, said third section and said second section converging at an obtuse angle;

a fourth section, said fourth section and said third section converging at an acute angle, said fourth section and said first section converging at an obtuse angle;

said first section, said second section, said third section, and said fourth section forming a diamond shaped nail extractor.

14. The dual head hammer of claim 1, wherein said receiving orifice is an elliptically shaped orifice formed in said dual head, said receiving orifice physically receiving and impinging said upper portion of said handle.

15. A dual headed hammer comprising:

a linearly elongated handle having an upper portion opposite to a lower portion, said handle having measurement etchings measuring 1.5 inches in length from a base of said handle and extending to an uppermost ringed etching, said handle measuring 17.5 inches in length from a top surface of said hammer to a lower surface for quickly and accurately determining placement or location of a wall stud; and a dual head receiving and physically impinging said upper portion of said handle in a receiving orifice, each one of said heads for driving a nail.

16. The dual headed hammer of claim 15, wherein said dual head comprises:

a first head formed at an end of said dual head having a first face for striking a head of a nail;

a second head formed at an end opposite to said first head and having a second face for striking a head of a nail;

a plurality of nail holders formed in said second head.

17. The dual headed hammer of claim 16, wherein said plurality of nail holders comprises:

a top nail holder having an arcuate channel formed in a top surface of said second head, said top nail holder sized to accommodate large nails;

a first lateral nail holder having an arcuate channel formed in a lateral surface of a second head, said first lateral nail holder sized to accommodate small nails; and a second lateral nail holder having an arcuate channel formed in a lateral surface of said second head, opposite to said first lateral nail holder, said second lateral nail holder sized to accommodate intermediate nails.

18. The dual headed hammer of claim 15, wherein said dual head further comprises a nail extractor, said nail extractor formed in a top surface of said dual head and adjacent to said first head, said nail extractor for extracting impaled nails.

19. The dual headed hammer of claim 18, wherein said nail extractor comprises:

a first section;

a second section, said second section and said first section converging at an acute angle;

a third section, said third section and said second section converging at an obtuse angle;

a fourth section, said fourth section and said third section converging at an acute angle, said fourth section and said first section converging at an obtuse angle;

said first section, said second section, said third section, and said fourth section forming a diamond shaped nail extractor.

* * * * *